US008419170B2

(12) United States Patent
Andrews et al.

(10) Patent No.: US 8,419,170 B2
(45) Date of Patent: Apr. 16, 2013

(54) SCALABLE INKJET PRINTHEAD ARCHITECTURE AND METHOD OF MANUFACTURE

(75) Inventors: John R. Andrews, Fairport, NY (US); Steve Van Cleve Korol, Dundee, OR (US)

(73) Assignee: Xerox Corporation, Norwalk, CT (US)

( * ) Notice: Subject to any disclaimer, the term of this patent is extended or adjusted under 35 U.S.C. 154(b) by 279 days.

(21) Appl. No.: 12/850,714

(22) Filed: Aug. 5, 2010

(65) Prior Publication Data

US 2012/0033013 A1 Feb. 9, 2012

(51) Int. Cl.
*B41J 2/045* (2006.01)

(52) U.S. Cl.
USPC ..... 347/68

(58) Field of Classification Search ..... 347/67–72, 347/57–59
See application file for complete search history.

(56) References Cited

U.S. PATENT DOCUMENTS

| | | | | |
|---|---|---|---|---|
| 5,371,531 | A * | 12/1994 | Rezanka et al. | 347/43 |
| 5,880,756 | A | 3/1999 | Ishii et al. | |
| 6,224,184 | B1 | 5/2001 | Imanaka et al. | |
| 6,447,097 | B1 | 9/2002 | Folkins et al. | |
| 6,866,364 | B2 | 3/2005 | Torgerson et al. | |
| 7,261,401 | B2 | 8/2007 | Silverbrook et al. | |
| 2007/0229600 | A1 * | 10/2007 | Hashimoto | 347/58 |

* cited by examiner

*Primary Examiner* — Lamson Nguyen
(74) *Attorney, Agent, or Firm* — Maginot, Moore & Beck, LLP

(57) ABSTRACT

A method of manufacturing a printhead includes connecting an ink supply and driving electronics to a predetermined number of inkjet ejector sites. Each ejector site includes a fluid inlet and an electrical connector. The predetermined number of ejector sites connected to the ink supply and driving electronics is less than the total number of ejector sites available for use in the printhead.

24 Claims, 4 Drawing Sheets

SCALABLE INKJET PRINTHEAD ARCHITECTURE AND METHOD OF MANUFACTURE

TECHNICAL FIELD

This disclosure relates to the field of inkjet printing systems, and more particularly, to inkjet ejector arrays useful in inkjet printheads that are scalable over a wide range of resolutions.

BACKGROUND

Drop-on-demand ink jet printing systems eject ink drops from printhead nozzles in response to pressure pulses generated within the printhead by either piezoelectric devices or thermal transducers, such as resistors. The ejected ink drops, commonly referred to as pixels, are propelled towards an image receiving member where the ink drops form spots on the member. The printheads have drop ejecting nozzles and a plurality of ink containing channels, usually one channel for each nozzle, which interconnect an ink reservoir in the printhead with the nozzles.

In a typical piezoelectric ink jet printing system, the pressure pulses that eject liquid ink drops are produced by applying an electric pulse to the piezoelectric devices. Each piezoelectric device is individually addressable to enable a firing signal to be generated and delivered to each piezoelectric device. The firing signal causes the piezoelectric device receiving the signal to bend or deform and pressurize a volume of liquid ink in a pressure chamber adjacent the piezoelectric device. As pressure forces a quantity of ink to be displaced from the chamber to eject a drop of ink from the nozzle, commonly called an inkjet or jet, associated with each piezoelectric device. The ejected drops form an image on the image receiving member opposite the printhead. The respective channels from which the ink drops were ejected are refilled by capillary action from an ink supply.

The printing speed and image resolution of an inkjet printer depend, at least in part, on the density of ink ejectors in the printhead. In multi-pass printing, the print speed and image resolution can be traded off against one another to achieve a desired balance between print speed and image quality. The maximum resolution and print speed that a single inkjet printhead generates are determined, at least in part, by the number of inkjet ejectors present in the printhead. A greater inkjet ejector density allows for a printhead with a higher resolution and/or print speed. Being able to accommodate various print resolutions and speeds in the manufacturing of inkjet printing systems is important.

SUMMARY

A method for assembling a printhead has been developed. The method includes operatively connecting an electrical driving circuit to an electrical connector at each inkjet ejector site in a predetermined number of inkjet ejector sites, and operatively connecting a reservoir to a fluid inlet at each inkjet ejector site having an electrical connector to which the electrical driving circuit is operatively connected. Each fluid inlet is configured to enable fluid to flow from the reservoir to each inkjet ejector site associated with the reservoir, and the predetermined number of inkjet ejector sites that are operatively connected to the electrical driving circuit and the reservoir is less than a total number of inkjet ejector sites available for use in a printhead.

A printhead suitable for use in an inkjet printing device has been developed. The printhead includes a plurality of inkjet ejector sites, each inkjet ejector site having a fluid inlet and an electrical connecting pad, an electrical driving circuit, and a first reservoir configured to store liquid ink. The electrical driving circuit is operatively connected to the electrical connecting pads of a first number of inkjet ejector sites, and the first number is less than the plurality of inkjet ejector sites. At least one inkjet ejector site in the plurality of inkjet ejector sites is not connected to any electrical driving circuit. The reservoir is operatively connected to the fluid inlets of the inkjet ejector sites to which the electrical driving circuit is operatively connected.

A printhead suitable for use in an inkjet printing has been developed. The printhead includes a plurality of inkjet ejectors and a plurality of connectors configured to couple a first number of inkjet ejectors in the plurality of inkjet ejectors to a source of driving signals to enable the inkjet ejectors in the first number of inkjet ejector ejectors to be activated. A second number inkjet ejectors in the plurality of inkjet ejectors is decoupled from any driving signals to disable the inkjet ejectors in the second number of inkjet ejectors from being activated.

BRIEF DESCRIPTION OF THE DRAWINGS

The foregoing aspects and other features of an inkjet ejector arrangement and a method for manufacturing printheads including the inkjet ejector arrangement are explained in the following description, taken in connection with the accompanying drawings.

DETAILED DESCRIPTION

Figure 1:
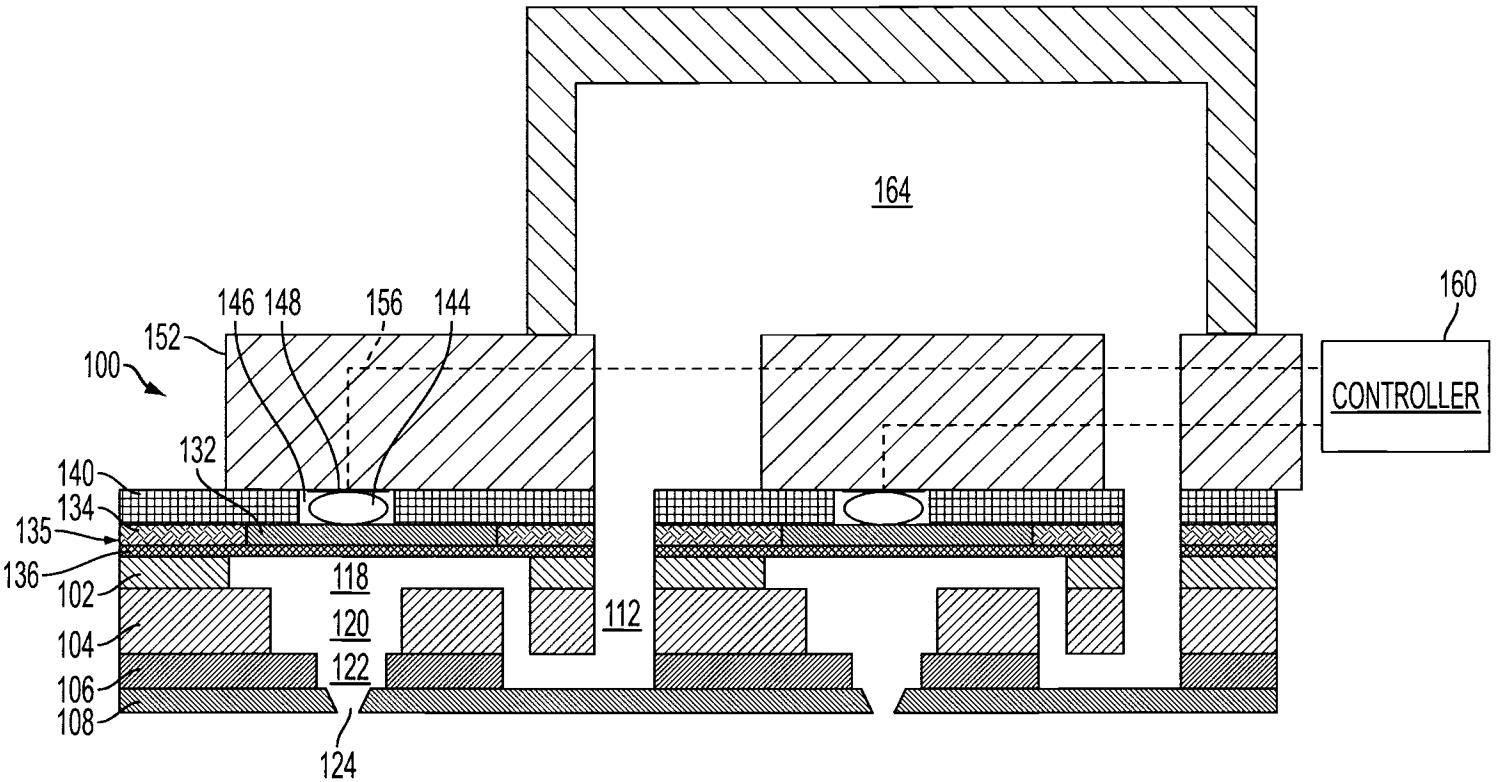
FIG. 1 is a cross sectional view of two inkjet ejectors that are connected to fluid ink paths and control electronics.

For a general understanding of the environment for the system and method disclosed herein as well as the details for the system and method, reference is made to the drawings. In the drawings, like reference numerals have been used throughout to designate like elements.

Referring to FIG. 1, an exemplary embodiment of two populated inkjet ejector sites is depicted. The inkjet ejector sites in FIG. 1 are referred to herein as "populated ejectors." A populated ejector, as used in this document, refers to an inkjet actuator that is operatively connected to a source of liquid ink and that is also electrically connected through an electrical pad to driving electronics. The driving electronics are also connected to a controller that provides the firing signals to activate the actuator in a populated inkjet ejector stack.

As exemplified in FIG. 1, an ejector site 100 includes an ejector stack including a standoff layer 140, actuator layer 135, diaphragm layer 136, body layer 102, outlet layer 104, outlet plate 106 and an aperture plate 108. Body layer 102 has one surface bonded to outlet layer 104, and an opposing surface bonded to diaphragm layer 136. A side of diaphragm layer 136 opposite body layer 102 is bonded to the actuator layer 135. Outlet layer 104 is bonded to outlet plate 106 on a side opposite body layer 102. An ink inlet 112, pressure chamber 118, and outlet chamber 120 are formed in the body layer 102 and outlet layer 104. Ink inlet 112 is placed in fluid communication with pressure chamber 118. Liquid ink enters ink inlet 112 and flows and into pressure chamber 118.

An ink reservoir, shown here as manifold 164, is in fluid communication with pressure chamber 118 via ink inlet 112. Alternative reservoir configurations may supply ink to ink inlet 112 via an external conduit such as a tube or channel. While FIG. 1 shows one reservoir, a multi-color printhead may include multiple reservoirs corresponding to various ink colors ejected by the printhead. For example, a CMYK printhead includes a reservoir for each of cyan, magenta, yellow, and black ink colors.

The outlet plate 106 is bonded to outlet layer 104 and aperture plate 108. Outlet plate 106 includes a plurality of outlet ports 122 corresponding to the outlet chamber 120 of each ejector. Aperture plate 108 includes a plurality of apertures, seen here as nozzles 124, formed at positions corresponding to the outlet ports 122 in outlet plate 106. In one embodiment, outlet plate 106 is a steel plate, and aperture plate 108 may be formed from a metallic or polymer layer.

Body layer 102 and outlet layer 104 form walls around pressure chamber 118, and a diaphragm layer 136 rigidly secured to actuator layer 135 overlays the pressure chamber 118. In the example embodiment of FIG. 1, actuator layer 135 includes a plurality of actuators 132 separated by interstitial material 134. Each actuator 132 may be a piezoelectric transducer, and diaphragm layer 136 is formed from a metallic sheet secured to the actuator 132. Interstitial material 134 secures the actuators 132 in place, and may be a thermoset polymer. A standoff layer 140 is bonded to the actuators 132 and interstitial material 134 on one side, and a circuit layer 152 on an opposing side. Standoff layer 140 has gaps 146 in its surface that correspond to the locations of actuators 132, with a conductive adhesive 144 placed in the gap 146 establishing an electrical connection between actuator 132 and electrical pad 148.

Piezoelectric actuator 132 in actuator layer 135 is configured to deflect into pressure chamber 118 in the direction of nozzle 124 in response to an electrical firing signal generated by driving electronics, exemplified by controller 160, and transmitted via electrical conductor 156 in circuit layer 152 through electrical pad 148 and flexible conductive adhesive 144. Flexible conductive adhesive 144 may be formed from an electrically conductive epoxy. Flexible layers 144 and 152 allow piezoelectric transducer 132 and diaphragm layer 136 to deform towards and away from pressure chamber 118.

A typical embodiment of circuit 152 is a flex circuit including a polymer ribbon having a plurality of electrical conductors such as conductor 156 running in parallel through the polymer ribbon. Alternative embodiments of circuit 152 include flexible or rigid electronic circuit boards having a plurality of electrically conductive traces connecting a controller to populated inkjet ejectors. Each conductor 156 is routed to have conductive points at an electrical connector of controller 160 and an electrical connector associated with each ejector site such as electrical pad 148.

In operation, ink from manifold 164 flows through ink inlet 112 into pressure chamber 118. Controller 160 generates an electrical firing signal sent through conductor 156, electrical pad 148, and flexible conductive adhesive 144 to actuator 132. When actuator 132 is a piezoelectric transducer, the diaphragm layer 136 deforms to force ink from the ink pressure chamber 118 through the outlet chamber 120, outlet port 122, and aperture 124. The expelled ink forms a drop of ink ejected from aperture 124. Refill of ink pressure chamber 118 following the ejection of an ink drop is augmented by reverse bending of piezoelectric actuator 132 and the concomitant movement of diaphragm layer 136 that draws ink from manifold 164 into pressure chamber 118.

The inkjet ejector site 100 depicted in FIG. 1 depicts an embodiment of an inkjet using an ejector stack, but various alternative inkjet ejectors including modifications to the embodiment of FIG. 1 may be employed as well. One such alternative ejector suitable for use in an inkjet ejector assembly similar to that of FIG. 1 is a thermal ejector. A thermal ejector includes a thermal actuator configured to heat ink in a pressure chamber such as pressure chamber 118. The thermal actuator includes a resistive thermal element which heats ink in response to an electrical current similar to the electrical firing signal generated by controller 160. The heating forms an expanding gas bubble in the pressure chamber. As the gas bubble expands, ink in the pressure chamber is urged through an inkjet ejector nozzle as an ink drop. A populated inkjet array may include either or both of the electromechanical or thermal inkjet ejectors.

Figure 2:
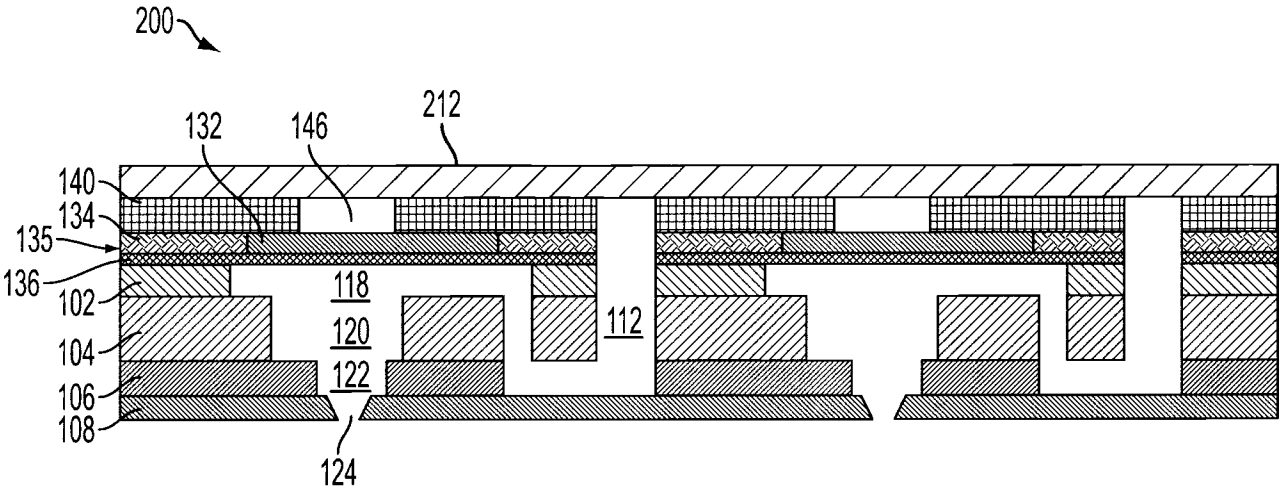
FIG. 2 is a cross-sectional view of two inkjet ejectors not connected to fluid ink paths and control electronics.

Referring to FIG. 2, two non-populated inkjet ejector sites formed using inkjet stack layers similar to that of FIG. 1 are shown. The ejector site 200 of FIG. 2 is disconnected from the fluid ink reservoir and driving electronics shown in FIG. 1. Ejector site 200 includes standoff layer 140, actuator layer 135, diaphragm layer 136, body layer 102, outlet layer 104, outlet plate 106 and an aperture plate 108. FIG. 2 depicts an optional cap layer 212 that covers the non-populated ejector sites. The cap layer may be used to protect the non-populated ejector sites, and may also serve as an offset to provide a uniform thickness between populated and non-populated inkjet ejector sites.

As shown in FIG. 2, non-populated ejector site 200 is disabled since it not configured to activate in response driving signals from a controller. While ejector site 200 is disconnected from both the electrical firing circuit and ink manifold, a non-populated inkjet ejector site may be disconnected from either the electrical firing circuit or the ink manifold. In one embodiment, an ink reservoir such as ink manifold 164 is placed in fluid communication with a non-populated ejector site, but the ejector site is not connected to driving electronics, and is not configured to eject ink drops. Alternative embodiments of non-populated ejector sites may omit some or all of these features in the inkjet stack. For example, non-populated ejector sites may omit the actuator components to reduce material usage and manufacturing costs.

Figure 3A:
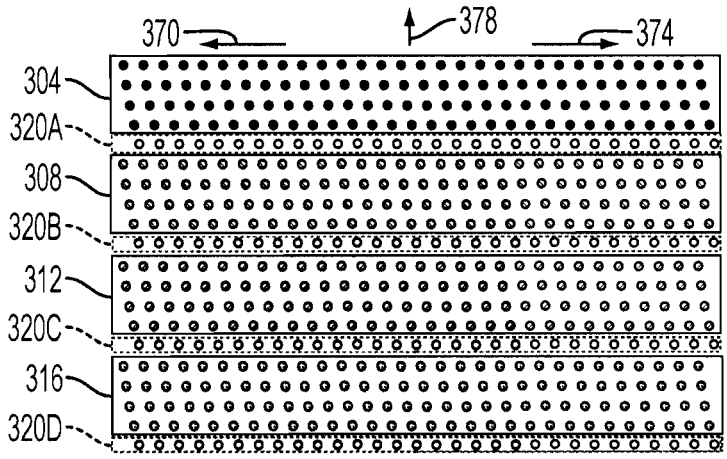
FIG. 3A is a frontal view of an arrangement inkjet ejector nozzles in a multi-color printhead.
Figure 3B:
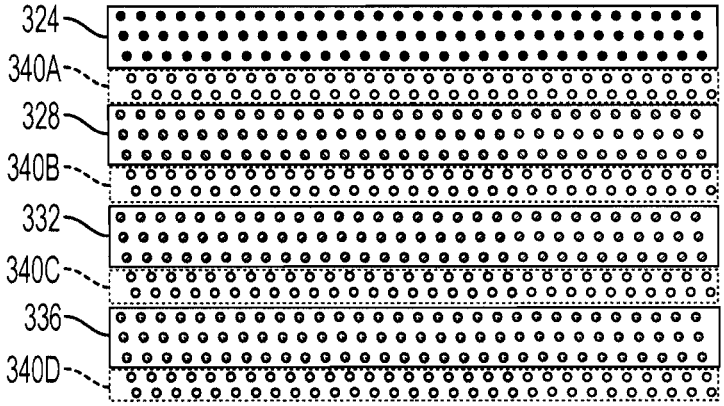
FIG. 3B is a frontal view of an alternative arrangement inkjet ejector nozzles in a multi-color printhead.
Figure 3C:
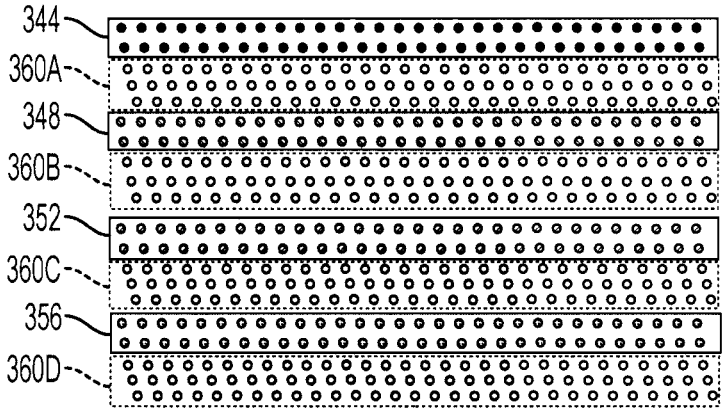
FIG. 3C is a frontal view of another alternative arrangement inkjet ejector nozzles in a multi-color printhead.

FIG. 3A-FIG. 3C depict some example inkjet ejector configurations that may be configured using inkjet ejector site arrangements similar to those depicted in FIG. 1. Each configuration in FIG. 3A-FIG. 3C includes twenty rows of inkjet ejector sites, which may be populated with inkjet ejectors to form printheads having various maximum resolutions. The rows of ejector sites are interlaced, allowing multiple rows of inkjet ejectors to eject ink drops on different positions in cross process directions 370 and 374. For each arrangement in FIG. 3A-FIG. 3C, an image receiving member moves in a process direction 378 relative to each of the inkjet ejector arrays. Populated inkjet ejector sites eject ink droplets in response to firing signals at predetermined times as the image receiving member travels in the process direction 378, forming an image. In alternative embodiments, the printhead may move in one or more of process direction 378 and cross-process directions 370 and 374 relative to the image receiving member. The image receiving member may be a print medium, such as paper, or may be an intermediate imaging member, such as a print drum or endless belt, which holds ink images formed by inkjet printheads.

In FIG. 3A, color groups 304, 308, 312 and 316 correspond to black, yellow, cyan, and magenta ink colors, respectively. Each of the color groups 304, 308, 312, and 316 includes four rows of populated inkjet ejector sites with corresponding ink drop ejector nozzles. Inkjet ejector site rows 320A-320D remain disconnected from a fluid ink path and driving electronics, and ejector site rows 320A-320C separate the populated color groups. In FIG. 3A, inkjet ejector row sites 320A-320D each include one row of inkjet ejector sites.

An alternative inkjet ejector arrangement is depicted in FIG. 3B. FIG. 3B depicts the same number of inkjet ejector sites as FIG. 3A, but with fewer rows of inkjet ejector sites including populated inkjet ejectors. Color groups 324, 328, 332, and 336 correspond to black, yellow, cyan, and magenta ink colors, respectively. Each of color groups 324, 328, 332, and 336 include three rows of populated inkjet ejector sites, while non-populated ejector groups 340A-340D each have two adjacent rows decoupled from an ink source and disconnected from driving electronics. The populated ejector groups are separated by groups 340A-340C. The ejector configuration of FIG. 3B has a lower density of populated inkjet ejectors for each color, producing a lower maximum print resolution or printing speed than the configuration of FIG. 3A.

Still another exemplary inkjet ejector arrangement using the same ejector site configuration as FIG. 3A and FIG. 3B with a lower density of populated inkjet ejectors is depicted in FIG. 3C. Color groups 344, 348, 352, and 356 correspond to black, yellow, cyan, and magenta ink colors, respectively. In FIG. 3C, each of color groups 344, 348, 352, and 356 includes two rows of populated inkjet ejector sites, while non-populated ejector groups 360A-360D each have three adjacent rows decoupled from an ink source and disconnected from driving electronics. The populated ejector groups are separated by groups 360A-360C. The ejector configuration of FIG. 3C has fewer rows of populated inkjet ejector sites than either FIG. 3A or FIG. 3B, producing a lower maximum print resolution.

While the color groups depicted in FIG. 3A-3C depict populated ejector groups having the same number of rows in each printhead, alternative printheads may populate different numbers of rows for selected colors. In one configuration, the black ink group may include more populated rows than each of the groups corresponding to other colors such as cyan, magenta, and yellow. This allows printing operations which strictly use black ink, such as printing monochromatic text, to print with higher resolutions and higher print speeds. Additionally, while FIG. 3A-FIG. 3C depict inkjet ejector sites populated in a pattern of rows, ejector sites may be selectively populated according to a variety of patterns. For example, instead of uniformly populating a single row of ejectors, an alternative pattern may include populating alternating ejectors in two or more rows using multiple colors of ink. A single color of ink may also be arranged in a diagonal pattern spanning multiple rows of ejector sites.

Figure 4:
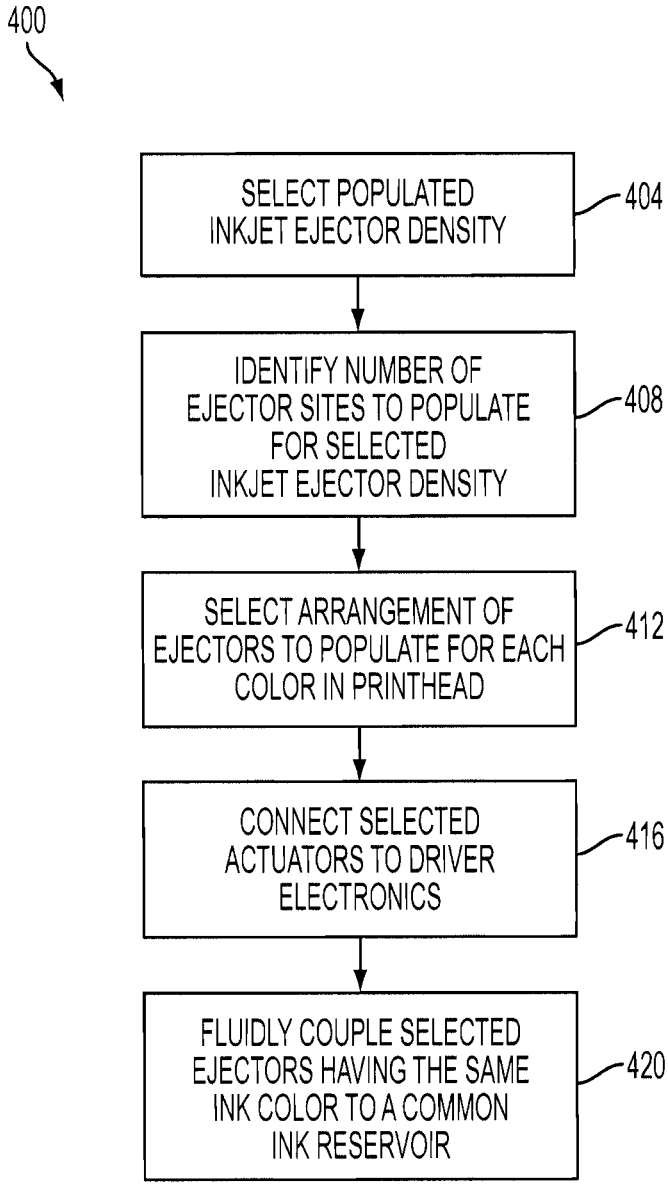
FIG. 4 is a block diagram of a process suitable for producing inkjet ejector assemblies for inkjet printheads.

A block diagram of a process 400 for arranging inkjet ejectors in rows to form ejector arrays described above is depicted in FIG. 4. Process 400 begins by selecting a populated ejector density for the completed printhead (block 404). The maximum resolution and printing speed intended for the finished printhead determines the populated ejector density, with higher densities corresponding to higher resolutions and print speeds. Because less densely populated printheads include fewer components, such as firing circuits and fluid connections to ink manifolds, a lower density of populated inkjet ejectors may reduce the manufacturing cost of the printhead.

The maximum resolution and print speed of an individual printhead is limited by the density of inkjet ejector sites available for population. While a minimum resolution of a functional inkjet ejector array could be selected to be as low as populating a single inkjet ejector, a more typical minimum resolution in a multi-color printhead employs one row of inkjet ejectors corresponding to each color of ink produced by the printhead.

Once the density of populated inkjet ejectors is selected, a corresponding number of ejector sites to be populated for each ink color are identified (block 408). An example resolution has a selected density of 120 ejectors-per-inch for each ejector group ejecting cyan, magenta, yellow, and black inks. Using an interlaced row of ejectors with thirty ejector sites per inch in each row, the 120 ejectors-per-inch resolution for four ink colors may be implemented by populating four rows of inkjet ejectors corresponding to each ink color.

Process 400 continues by selecting the arrangement of ejectors to populate for each color of ink present in the printhead (block 412). One method of selecting populated ejectors is to place rows of inkjet ejectors ejecting ink of the same color adjacent to one another, as seen in FIG. 3A, with color groups 304, 308, 312, and 316 each having four adjacent rows. The arrangement of populated inkjet ejectors may also include placing one or more rows of ejector sites not selected to eject ink between the rows of populated inkjet ejectors that form color groups. Again referring to FIG. 3A, ejector site rows 320A-320D are not selected to be populated with inkjet ejectors, and each of the rows 320A-320C separates two groups of populated inkjet ejectors that are configured to eject ink of different colors.

After the inkjet ejector sites to be populated are selected, an actuator in each of the selected inkjet ejector sites is electrically connected to driving electronics, such as controller 160 of FIG. 1 (block 416). The driving electronics generate electrical firing signals, and each inkjet ejector emits an ink drop in response to receiving an electrical firing signal. As described above, each inkjet ejector is typically connected to driving electronics via a flex circuit. The complexity of the flex circuit varies depending upon the number of inkjet ejector sites that are connected to ejector bodies, with lower resolution printheads using flex circuits with fewer conductors. Each of the populated ejector sites is also fluidly connected to an ink reservoir, such as a manifold, via a fluid conduit connecting the ink reservoir to the ink inlet in each ejector site (block 420). In one embodiment, one or more rows of ejectors may be fluidly connected to a single reservoir, and a single printhead may have a plurality of reservoirs. A person having ordinary skill in the art may carry out process 400 with process steps 416 and 420 occurring in any order.

Selectively populating an array of inkjet ejector sites permits a single ejector design to be used for manufacturing printheads having various maximum printhead resolutions and printing speeds. Printheads having various populated ejector densities use different configurations and quantities of common inkjet ejector components. Reusing known inkjet printhead components in such a manner improves the efficiency of designing and manufacturing printheads having a wide range of performance characteristics.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

We claim:

1. A method for assembling a printhead comprising:

operatively connecting an electrical driving circuit to an electrical connector at each inkjet ejector site in a predetermined number of inkjet ejector sites;

operatively connecting a reservoir to a fluid inlet at each inkjet ejector site having an electrical connector to which the electrical driving circuit is operatively connected, each fluid inlet being configured to enable fluid to flow from the reservoir to each inkjet ejector site operatively connected to the reservoir, the predetermined number of inkjet ejector sites being operatively connected to the electrical driving circuit and to the reservoir being less than a total number of inkjet ejector sites available for use in a printhead; and leaving another number of inkjet ejector sites in the printhead unconnected to the electrical driving circuit.

2. The method of claim 1 further comprising:

arranging the predetermined number of inkjet ejector sites in a predetermined pattern.

3. The method of claim 2 further comprising:

operatively connecting the fluid inlet of each inkjet ejector site in a first number of the predetermined number of inkjet ejector sites to a first reservoir; and operatively connecting the fluid inlet of each inkjet ejector site in a second number of the predetermined number of inkjet ejector sites to a second reservoir, the first number of inkjet ejector sites being greater than the second number of inkjet ejector sites.

4. The method of claim 3 further comprising:

supplying black ink from the first reservoir to the first number of the predetermined number of inkjet ejector sites.

5. The method of claim 2 further comprising:

arranging the predetermined pattern of inkjet ejector sites into a plurality of rows.

6. The method of claim 5 further comprising:

operatively connecting the fluid inlet of each inkjet ejector site in at least one row of inkjet ejectors to a first reservoir.

7. The method of claim 6 further comprising:

operatively connecting the fluid inlet of each inkjet ejector site in at least one other row of inkjet ejectors to a second reservoir.

8. The method of claim 5 further comprising:

operatively connecting a fluid conduit to the fluid inlet of each inkjet ejector site in at least two rows of inkjet ejectors and operatively connecting the fluid conduit to a first reservoir; and operatively connecting a fluid conduit to the fluid inlet of each inkjet ejector site in at least two other rows of inkjet ejectors and operatively connecting the fluid conduit to a second reservoir.

9. A printhead suitable for use in an inkjet printing device comprising:

a plurality of inkjet ejector sites, each inkjet ejector site having a fluid inlet and an electrical connecting pad;

an electrical driving circuit, the electrical driving circuit being operatively connected to the electrical connecting pads of a first number of inkjet ejector sites, the first number being less than the plurality of inkjet ejector sites;

at least one inkjet ejector site in the plurality of inkjet ejector sites not being connected to any electrical driving circuit;

a first reservoir configured to store liquid ink, the reservoir being operatively connected to the fluid inlets of the inkjet ejector sites to which the electrical driving circuit is operatively connected.

10. The printhead of claim 9, the plurality of inkjet ejector sites being arranged in a predetermined pattern.

11. The printhead of claim 10, the predetermined pattern further comprising:

a plurality of rows, each row having a predetermined number of inkjet ejector sites.

12. The printhead of claim 9 further comprising:

a second reservoir configured to store liquid ink, the reservoir being operatively connected to the fluid inlets of a second number of inkjet ejector sites, a sum of the first number and the second number being less than the plurality of inkjet ejector sites; and the electrical driving circuit being operatively connected to the electrical connecting pads of the inkjet ejector sites to which the second reservoir is operatively connected.

13. The printhead of claim 12 further comprising:

the first number of inkjet ejector sites being greater than the second number of inkjet ejector sites.

14. The printhead of claim 12 wherein the first reservoir stores black ink.

15. The printhead of claim 12, the first number of inkjet ejector sites being arranged in a first row and the second number of inkjet ejector sites being arranged in a second row.

16. The printhead of claim 12, the first number of inkjet ejector sites being arranged in at least two rows and the second number of inkjet ejector sites being arranged in at least two rows.

17. The printhead of claim 16 wherein the at least two rows of inkjet ejector sites operatively connected to the first reservoir are interlaced with respect to each other.

18. The printhead of claim 16 wherein the at least two rows of inkjet ejector sites operatively connected to the second reservoir are interlaced with respect to each other.

19. The printhead of claim 16 wherein the at least two rows of inkjet ejector sites operatively connected to the first reservoir are aligned with the at least two rows of inkjet ejector sites operatively connected to the second reservoir.

20. A printhead suitable for use in an inkjet printing device comprising:

a plurality of inkjet ejectors; and a plurality of connectors configured to couple a first number of inkjet ejectors in the plurality of inkjet ejectors to a source of driving signals to enable the inkjet ejectors in the first number of inkjet ejector ejectors to be activated; and a second number inkjet ejectors in the plurality of inkjet ejectors being decoupled from any driving signals to disable the inkjet ejectors in the second number of inkjet ejectors from being activated.

21. The printhead of claim 20 wherein the first number of inkjet ejectors are arranged in a first number of rows, and the second number of inkjet ejectors are arranged in a second number of rows.

22. The printhead of claim 20, each inkjet ejector further comprising:

a fluid inlet and an electrical connecting pad;

the source of driving signals being an electrical driving circuit electrically connected to the plurality of connectors, the connectors being operatively connected to the electrical connecting pads of the first number of inkjet ejectors; and a first reservoir configured to store liquid ink, the first reservoir being operatively connected to the fluid inlets of a first group of inkjet ejectors, the first group of inkjet ejectors being fewer than the first number of inkjet ejectors.

23. The printhead of claim 22 further comprising:

a second reservoir configured to store liquid ink, the reservoir being operatively connected to the fluid inlets of a second group of inkjet ejectors in the first number of inkjet ejectors, the first group of inkjet ejectors and the second group of inkjet ejectors being mutually exclusive.

24. The printhead of claim 23 wherein the first group of inkjet ejectors has a greater number of inkjet ejectors than the second group of inkjet ejectors.

* * * * *